United States Patent [19]

Anderson

[11] 4,209,418

[45] Jun. 24, 1980

[54] GELATIN BENZIMIDAZOLE BLENDS AS INHIBITORS FOR CARBOXYLIC ACIDS

[75] Inventor: James D. Anderson, Ambler, Pa.

[73] Assignee: Union Carbide Corporation, New York, N.Y.

[21] Appl. No.: 925,832

[22] Filed: Jul. 18, 1978

[51] Int. Cl.[2] ..... C11D 7/08; C23G 1/06

[52] U.S. Cl. ..... 252/148; 252/142; 252/146; 252/149; 252/388; 252/390; 252/391; 252/394; 134/3; 134/41

[58] Field of Search ..... 252/148, 149, 146, 142, 252/391, 394, 388, 390; 134/3, 41

[56] References Cited

U.S. PATENT DOCUMENTS

| | | | |
|---|---|---|---|
| 1,736,118 | 11/1929 | Gravell | 252/149 |
| 2,392,404 | 1/1946 | Peterson | 252/149 |
| 2,823,184 | 2/1958 | Plump et al. | 252/391 X |
| 3,072,502 | 1/1963 | Alfano | 134/3 |
| 3,345,296 | 10/1967 | Lutz | 252/148 X |
| 3,492,238 | 1/1970 | Wohlberg | 252/148 X |
| 3,664,870 | 5/1972 | Oberhofer et al. | 134/3 |
| 3,728,267 | 4/1973 | Hirota et al. | 252/142 |
| 3,729,423 | 4/1973 | Hirota | 252/142 |
| 3,876,371 | 4/1975 | Costain et al. | 252/148 X |

FOREIGN PATENT DOCUMENTS 1052771 12/1966 United Kingdom .

OTHER PUBLICATIONS

Desai, "Mechanism of Gelatin Inhibitor Action on the Corrosion of Brass in Citric Acid Based on Potential and Polarization Measurements," Werkstoffe Korrosion 16(8), 681-685, (1965), CA 64:3162c.

*Primary Examiner*—Harris A. Pitlick
*Attorney, Agent, or Firm*—John S. Piscitello

[57] ABSTRACT

Compositions comprising a mixture of gelatin and a compound of the formula:

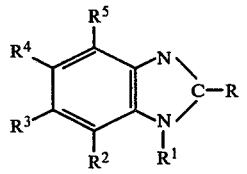

wherein R, $R^1$, $R^2$, $R^3$, $R^4$ and $R^5$ are each a group selected from the class consisting of —H, —Cl, $—CHCl_2$, $—CH_2Cl$, $—CCl_3$, —SH, $—SCH_3$, $—NH_2$, —NHC≡N, $—CH_2C≡N$, $$—NHC\overset{O}{\overset{\|}{}}NH_2, \quad —NHC\overset{NH_2}{\overset{|}{=}}NH,$$

$—CH_2OH$, $—NO_2$ and monovalent hydrocarbon radicals having from 1 to about 18 carbon atoms, provide effective corrosion inhibition for aqueous carboxylic acid solutions in the cleaning of metal industrial equipment.

21 Claims, No Drawings

GELATIN BENZIMIDAZOLE BLENDS AS INHIBITORS FOR CARBOXYLIC ACIDS

FIELD OF THE INVENTION

This invention pertains to compositions for use as inhibitors in the carboxylic acid cleaning of metal. In particular, this invention pertains to a synergistic combination of gelatin and a compound of the formula:

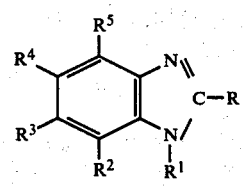

wherein R, $R^1$, $R^2$, $R^3$, $R^4$ and $R^5$ are each a group selected from the class consisting of —H,—Cl,—$CHCl_2$,—$CH_2Cl$,—$CCl_3$, —SH,—$SCH_3$,—$NH_2$,—NHC≡N,—$CH_2C$≡N, $$-NHC(=O)NH_2, \quad -NHC(NH_2)=NH,$$

—$CH_2OH$,—$NO_2$ and monovalent hydrocarbon radicals having from 1 to about 18 carbon atoms, which together can be effectively utilized as an inhibitor additive to carboxylic acid cleaning solutions in order to minimize the loss of basis metal during the removal of accumulations of water-insoluble deposits from metal surfaces.

BACKGROUND AND DESCRIPTION OF THE PRIOR ART

Acid cleaning operations are commonly employed to remove adhering substances, such as mill scale and fly ash, from the interior surface of vessels, tubes and related industrial processing equipment, particularly where such equipment is fabricated from ferrous metals. Aqueous processing equipment, especially that operating at elevated temperatures, tends to acquire a build-up of insoluble deposits. Typically, acid cleaning is used to remove these deposits. For example, acid cleaning is employed to remove lime deposits or water scale from power plant boilers and piping systems and evaporating equipment. Likewise, acid cleaning is employed to remove scale and deposits from processing equipment in such plants as refineries, utility companies, paper mills, chemical plants, and the like. Since cleaning acid tends to remove a portion of the basis metal of the industrial equipment with each cleaning, the use of inhibitors to minimize basis metal loss in acid cleaning can substantially extend the life of the equipment.

Similar acid cleaning solutions are also used in acid pickling for the removal of undesirable oxide coatings from metals (usually ferrous metals) before subjecting them to further treatment such as phosphate coating, enameling, electroplating and the like.

The art recognizes a variety of acids for chemical cleaning such as, for example, inorganic acids such as hydrochloric, sulfuric, nitric and phosphoric acids, and organic acids such as formic, citric, and alkylene polyamine carboxylic acids.

Although the complexity of the inhibition phenomena is such that there are no particular criteria by which one can predict the inhibiting power of degree of inhibition that can be achieved with any particular inhibitor, a variety of inhibitors for acid cleaning systems are well known in the art. Despite the fact that there does not appear to be any recognized basis for correlating chemical structure to inhibiting strength, a number of suitable inhibitors have been found among the organic amines and the organic sulfur-containing compounds. Sulfur-free inhibitors are increasingly preferred since sulfur-containing compounds may leave a residue of polythionic acid on the basis metal of the equipment being cleaned. Polythionic acid is known to produce metal pitting.

Several aromatic amines are known to be useful as inhibitors. By way of illustration, U.S. Pat. No. 2,692,191 discloses alkyl-substituted mercaptobenzimidazoles as inhibitors for unsaturated mineral oil, such as cracked gasoline, against corrosion of metals. U.S. Pat. No. 3,091,591 discloses cyclic saturated amines for non-oxidizing alkaline and acidic corrodant systems to inhibit the corrosion of ferrous metals. U.S. Pat. No. 2,671,807 discloses a process for producing N-dialkyl-substituted aromatic amines which are mentioned as being useful as corrosion inhibitors for metal surfaces. U.S. Pat. No. 2,724,695 discloses compounds as metal inhibitors in natural oil-brine mixtures which contain both an imidazoline ring and a imidazolidine ring. U.S. Pat. No. 2,727,003 discloses imidazoline ring containing compounds as inhibitors for natural petroleum-oil brine mixtures to reduce their corrosive action upon oil field equipment.

Though it is common practice to blend two, three or more known inhibitors in an effort to provide acid inhibition suitable to specific conditions, the instances where such blends produce an inhibitor combination of unexpectedly enhanced inhibition strength are rare. Those few synergistic combinations which are known generally involve an amine as one of the essential components. One of the earliest known examples of synergism in acid inhibitors, is the amine/thiourea combination. When used in sulfuric acid as a pickling inhibitor, amines are not effective and thioureas have only moderate value. However, the combination of amines and thioureas produces an effective inhibitor combination for sulfuric acid pickling. Another instance in which an amine is essential is the combination of acetylenic alcohols and nitrogen compounds in hydrochloric acid. Both inhibitors are only reasonably effective when used alone, but together they provide an excellent inhibitor. Still another example of a synergistic combination also involving an amine can be found in U.S. Pat. No. 3,382,179 wherein an acetylenic compound, an amine and naphthenic acid are combined to provide a synergistic combination.

It has now been found that gelatin together with a compound selected from a specific class of aromatic amines provides particularly effective inhibition for aqueous carboxylic acid solutions in the cleaning of metal industrial equipment.

OBJECTS

It is an object of the present invention to provide carboxylic acid cleaning solutions that will minimize the loss of basis metal during the acid cleaning of industrial equipment.

It is another object of the present invention to provide a cleaning solution that is particularly suited for the cleaning of nuclear steam generating equipment.

It is a further object of the present invention to provide an inhibitor blend which, when used in carboxylic acid cleaning of metal, will provide a substantial reduction in basis metal loss.

These and other objects will become apparent from a reading of the detailed specification.

SUMMARY OF THE INVENTION

This invention provides a novel acid inhibitor blend which is particularly useful for chemical cleaning with aqueous solutions of at least one carboxylic acid. The inhibitor blend comprises gelatin and a compound of the formula:

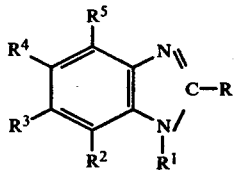

wherein R, $R^1$, $R^2$, $R^3$, $R^4$ and $R^5$ are each a group selected from the class consisting of —H,—Cl,—$CHCl_2$,—$CH_2Cl$,—$CCl_3$, —SH,—$SCH_3$,—$NH_2$,—NHC≡N,—$CH_2C$≡N, $$-NH\overset{O}{\overset{\|}{C}}NH_2,\quad -NH\overset{NH_2}{\overset{|}{C}}{=}NH,$$

—$CH_2OH$,—$NO_2$ and monovalent hydrocarbon radicals having from 1 to about 18 carbon atoms.

Another aspect of the present invention relates to a cleaning solution comprising:

(1) from about 75 to about 99.99 weight percent of an aqueous solution of at least one carboxylic acid, the pH of said aqueous solution being between about 1.7 and about 7; and (2) from about 0.01 to about 25 weight percent of an inhibitor blend comprising gelatin and a compound of the formula:

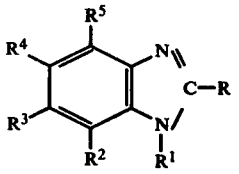

wherein R, $R^1$, $R^2$, $R^3$, $R^4$ and $R^5$ are each a group selected from the class consisting of —H,—Cl,—$CHCl_2$,—$CH_2Cl$, —CClhd 3,—SH,—$SCH_3$,—$NH_2$,—NHC≡N,—$CH_2C$≡N $$-NH\overset{O}{\overset{\|}{C}}NH_2,\quad -NH\overset{NH_2}{\overset{|}{C}}{=}NH,$$

—$CH_2OH$,—$NO_2$ and monovalent hydrocarbon radicals having from 1 to about 18 carbon atoms, said weight percentages being based on the combined total weight of components (1) and (2) contained in the cleaning solution.

A further aspect of the present invention provides a cleaning composition concentrate blend comprising:

(3) from about 25 to about 99.95 weight percent of at least one carboxylic acid; and (4) from about 0.05 to about 75 weight percent of a blend comprising gelatin and a compound of the formula:

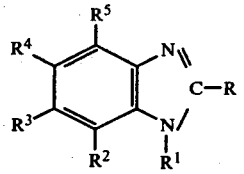

wherein R, $R^1$, $R^2$, $R^3$, $R^4$ and $R^5$ are each a group selected from the class consisting of—H,—Cl,—$CHCl_2$,—$CH_2Cl$, —$CCl_3$,—SH,—$SCH_3$,—$NH_2$,—NHC≡N,—$CH_2C$≡N $$-NH\overset{O}{\overset{\|}{C}}NH_2,\quad -NH\overset{NH_2}{\overset{|}{C}}{=}NH,$$

—$CH_2OH$,—$NO_2$ and monovalent hydrocarbon radicals having from 1 to about 18 carbon atoms, said weight percentages being based on the combined total weight of components (3) and (4) contained in the blend.

Yet another aspect of the invention relates to a novel process for cleaning water scale or other undesirable water insoluble deposits from the interior surfaces of metal industrial equipment such as conventional or nuclear steam generating equipment. The process comprises contacting these deposits with an aqueous carboxylic acid cleaning solution (preferably an ammoniated aqueous solution of ethylenediaminetetraacetic acid (EDTA) and/or citric acid) which comprises water, carboxylic acid and an inhibitor blend comprising gelatin and a compound of the formula:

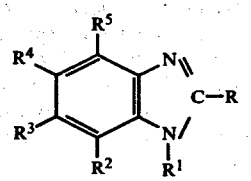

wherein R, $R^1$, $R^2$, $R^3$, $R^4$ and $R^5$ are each a group selected from the class consisting of—H,—Cl,—$CHCl_2$,—$CH_2Cl$,—$CCl_3$, —SH,—$SCH_3$,—$NH_2$,—NHC≡N,—$CH_2C$≡N, $$-NH\overset{O}{\overset{\|}{C}}NH_2,\quad -NH\overset{NH_2}{\overset{|}{C}}{=}NH,$$

—$CH_2OH$,—$NO_2$ and monovalent hydrocarbon radicals having from 1 to about 18 carbon atoms.

In the process, the inhibitor blend is used to inhibit the attack of the acid in the acid solution upon the basis metal of the industrial equipment.

DESCRIPTION OF THE PREFERRED EMBODIMENTS

The carboxylic acid useful in the cleaning solutions and cleaning composition concentrate blends of the present invention can be any carboxylic acid such as, for example, citric, formic, oxalic, acetic, glycolic, pyruvic, malonic, propionic, lactic, β-hydroxypropionic, methoxyacetic glyceric, β-iodopropionic, maleic, oxaloacetic, crotonic, vinylacetic, succinic, methylmalonic, malic, tartaric, n-butyric and isobutyric acids. Useful carboxylic acids also include amine-containing carboxylic acids such as, for example: ethylenediaminetetraacetic acid (EDTA), 2-amino-β-hydroxypropionic acid, iminodiacetic acid and aminosuccinic acid. Generally, useful carboxylic acid will have between 1 and about 30 carbon atoms.

The carboxylic acids employed in the cleaning solutions of the present invention may be present as an aqueous solution of one or more of the above-mentioned acids or as an aqueous solution of at least one ammoniated carboxylic acid. Suitable pH's for these aqueous solutions range from about 1.7 to about 7 (preferably from about 3 to about 6.5). The acid concentration in these aqueous solutions is not narrowly critical and can be any concentration as long as the aqueous solution pH is within the above-specified range. Preferably, the acid concentration in the aqueous solution is from about 1 to about 30 (more preferably from about 2 to about 20) weight percent based on the total amount of water and acid in said acid solution. The use of ammoniated carboxylic acids, particularly ammoniated citric acid, to remove copper-containing iron oxide scale from metal surfaces is known in the art, as disclosed in U.S. Pat. No. 3,072,502, incorporated herein by reference. The inhibitor blends of the instant invention have been found particularly effective in ammoniated EDTA and ammoniated citric acid/EDTA cleaning solutions.

The ammoniated carboxylic acids can be produced by any known method, such as, for example, the bubbling of ammonia through an aqueous solution of the carboxylic acid or the addition of ammonium hydroxide to said aqueous solution.

To form the cleaning composition concentrate blends of the present invention, the carboxylic acid is employed in either solid or liquid form, and the resulting concentrate blend can be either solid or liquid. A cleaning solution can easily be produced from the concentrate blend at the cleaning site by dilution of the blend with water.

As has been indicated above, the inhibitor blend of the present invention comprises (a) gelatin and (b) a compound of the formula:

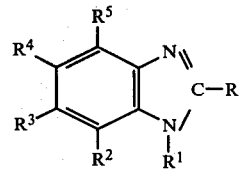

wherein R, $R^1$, $R^2$, $R^3$, $R^4$ and $R^5$ are each a group selected from the class consisting of —H,—Cl,—$CHCl_2$,—$CH_2Cl$,—$CCl_3$, —SH,—$SCH_3$,—$NH_2$,—NHC≡N,—$CH_2C$≡N, $$-NHC(=O)NH_2, \quad -NHC(NH_2)=NH,$$

—$CH_2OH$,—$NO_2$ and monovalent hydrocarbon radicals having from 1 to about 18 carbon atoms.

The monovalent hydrocarbon may be linear chain, branch-chain, cyclic, polycyclic or heterocyclic, and they may be the same or different groups which can be alkyl, alkenyl, alkynyl, aryl, alkaryl or aralkyl radicals. Useful monovalent hydrocarbon groups would include, for example, methyl, ethyl, propyl, nonyl, dodecyl, octadecyl, isobutyl, phenyl, hydroxyphenyl, dodecyl phenyl, benzyl, phenylethyl and 4-hydroxy-3,5-dimethylphenyl. Useful inhibitors within the scope of the above formula include, for example, 2-aminobenzimidazole, 2-amino-5,6-dimethylbenzimidazole, 2-chloromethylbenzimidazole, 2-phenylbenzimidazole, 5,6-dimethylbenzimidazole, 2-guandinobenzimidazole, 2-mercaptobenzimidazole, 2-methylbenzimidazole, 2-methylmercaptobenzimidazole, 2-methyl-5-nitrobenzimidazole, 2-methyl-5-octadecylbenzimidazole, 6-nitrobenzimidazole, 2-(trichloromethyl)benzimidazole, 2,5,6-trimethylbenzimidazole, 2-amino-5-chlorobenzimidazole, 5-methylbenzimidazole, 2-benzimidazole carbamonitrile, 2-benzimidazole methanol, 2-benzimidazolyl acetonitrile and 2-benzimidazolyl urea, as well as the preferred compound, benzimidazole. The gelatin employed in the inhibitor blend is preferably crude gelatin such as, for example, PCS-1 EXTRA SPECIAL FINE GROUND GLUE, a product of Peter Cooper Corporation, Gowanda, N.Y. The amount of components (a) and (b) in the inhibitor blend is not critical and can vary over a wide range. Preferably, the blend will contain from 95 to 5 parts by weight of (a) and from 5 to 95 parts by weight of (b) per 100 parts by weight of (a) and (b).

If desired, additional ingredients can be present in the inhibitor blend in minor amounts such as, for example, from about 0.5 to about 40 weight parts based upon the total parts by weight of the blend. For example, minor amounts of ethyl quinolinium iodide and 2-thio-4, 6-dimethyl pyrimidine hydrochloride have been found to contribute to effective inhibition in ammoniated EDTA cleaning solutions.

The process of the present invention is preferably effected at atmospheric pressure, although super-or subatmospheric pressure may be used if desired for some purpose.

The cleaning solutions of the present invention are preferably employed at an elevated temperature. Although the solution temperature can vary over a wide range, suitable temperatures would include those from about 150° F. or lower to about 220° F. or higher.

The process and cleaning solutions of the present invention are useful for any industrial equipment such as, for example, chemical process equipment, evaporators, and conventional and nuclear steam generating equipment. While such equipment often consists of ferrous metals, particularly mild steel, the instant cleaning solutions can also be utilized to clean other metals such as copper, brass, stainless steel and other alloys. The instant process and cleaning solutions are well suited for the pre-start-up cleaning and periodic maintenance cleanings of nuclear steam generating equipment.

As will become evident from the examples which follow, the particular synergistic effect obtained with the instant inhibitor blend provides a special advantage for carboxylic acid cleaning of metal. However, the inhibitor blend can also be employed where acid inhibitors are generally utilized, such as in metal pickling operations and oil well acidizing processes.

The following Examples are illustrative of, but are not intended to limit, the present invention.

As used herein, "g" denotes grams, "wt." denotes weight, "lbs." denotes pounds, "sq. ft." denotes square feet, "hr." denotes hours and "ml." denotes mililiters.

EXPERIMENTAL

The following experimental description illustrates the present invention.

EXAMPLE 1

Benzimidazole, which is representative of component (b) of the inhibitor blend of the present invention, is a commercially available product. If desired, it can be prepared from readily available starting materials, and the entire reaction product can be used in formulating the inhibitor blend. A suitable method for preparing benzimidazole is as follows:

Into a 500 ml. flask was placed 86.5 grams of recrystallized o-phenylenediamine and 49.1 grams of 90 weight percent formic acid in water. The mixture was heated to 100° C. and maintained at that temperature for 2 hours. The mixture was then cooled to room temperature before adding an aqueous solution of 10 weight percent NaOH to the stirred mixture in an amount sufficient to produce a slightly alkaline mixture. Crude benzimidazole was collected in a Buckner funnel and washed with cold water.

The crude benzimidazole was recrystallized by dissolving it in boiling water which contained activated charcoal. The mixture was boiled for 15 minutes, filtered through a heated Buckner funner, and then allowed to cool. The benzimidazole crystallized out of the solution upon cooling of the mixture, and it was collected in a Buchner funnel and washed with cold water to produce purified benzimidazole.

To produce the inhibitor blend, crude gelatin (PCS-1 EXTRA SPECIAL FINE GROUND GLUE) was added to the purified benzimidazole in the amounts specified in Tables I and II below. As can be seen from Tables I and II, tests were also conducted using, in addition to gelatin and benzimidazole, ethyl quinolinium iodide and 2-thio-4, 6-dimethyl pyrimidine hydrochloride.

EXAMPLE 2

Cleaning solutions were prepared by adding the inhibitor blend produced in accordance with Example 1 in an amount specified below, to 100 ml. of a 10 wt. percent aqueous solution of EDTA that had been ammoniated to a pH of 4.8 using $NH_4OH$ (CP grade, 28–30 wt.-percent). As a comparison, cleaning solutions were prepared using benzimidazole and gelatin as sole inhibitors in the amounts specified below.

The inhibiting strength of the inhibitors in the cleaning solutions was determined as follows:

A strip of mild steel (1010 cold rolled steel) ½ inch wide by 7 inches long is prepared by solvent wiping with acetone on a cotton rag, then bending the strip to a suitable shape for immersion in the test solution, generally an "S" shape. In order to remove all rust the strip is then pre-pickled for 5 minutes in a 50 percent by volume solution of concentrated hydrochloric acid (23° Baume, CP grade) in water. The acid is drained off and the strip is rinsed with tap water several times. The strip is then rinsed in acetone, the acetone is poured off, and the strip is blotted dry with a cotton rag. The dried, cleaned strip, which has a surface area of about 7 square inches, is weighed and then immersed into one of the 200° F. cleaning solutions for a period of 24½ hours. The strip is then removed from the cleaning solution, rinsed in warm tap water, and dipped in acetone. The acetone is dried off, and the strip is then again weighed to determine the metal weight loss from the strip in grams.

The weight loss in grams as measured in the above-described test is converted to weight loss in lbs./sq. ft./24 hours by multiplying the weight loss in grams times 0.045. For industrial chemical cleaning, it is preferred that the weight loss not exceed 0.005 lbs./sq. ft./24 hours.

The results are presented in Table I which follows:

TABLE I

| Run # | Inhibitor | Amount of Inhibitor (grams in 100 ml of Ammoniated EDTA Cleaning Solution) | Wt, Loss (in grams) | Wt, Loss (lbs/sq ft/24 hr) |
|---|---|---|---|---|
| 1[1] | benzimidazole | 5.0 | 0.3440 | 0.0156 |
| 2 | gelatin | 5.0 | 0.2061 | 0.0093 |
| 3 | gelatin | 5.0 | | |
| | 2-thio-4,6-dimethyl pyrimidine hydrochloride | 0.1 | 0.1427 | 0.0065 |
| 4 | Gelatin | 2.5 | 0.0599 | 0.0027 |
| | benzimidazole | 2.5 | | |
| 5 | gelatin | 2.5 | | |
| | benzimidazole | 2.5 | 0.0599 | 0.0027 |
| | 2-thio-4, 6-dimethyl pyrimidine hydrochloride | 0.1 | | |
| 6 | gelatin | 1.7 | | |
| | benzimidazole | 1.7 | 0.0414 | 0.0019 |
| | ethyl quinolinium iodide | 1.7 | | |
| 7 | gelatin | 1.7 | | |
| | benzimidazole | 1.7 | 0.0311 | 0.0014 |
| | ethyl quinolinium iodide | 1.7 | | |
| | 2-thio-4, 6-dimethyl pyrimidine hydrochloride | 0.1 | | |

[1]Run 1 was made using a cleaning solution have a pH of 4.5. All other runs were made at a pH of 4.8.

As can be seen from the results given in Table I, the 2-component (Runs 3 and 4), 3-component (Runs 5 and 6) and 4-component (Run 7) inhibitor blends of the instant invention provide excellent inhibition for an ammoniated EDTA cleaning solution with a synergistic effect compared to the single component inhibitor (Runs 1 and 2).

EXAMPLE 3

Additional cleaning solutions were prepared by adding the inhibitor blends given in Table II to 100 ml. of an aqueous solution of 8 wt. percent EDTA and 4 wt. percent citric acid that had been ammoniated to a pH of 4.0 using $NH_4OH$ (CP grade, 28–30 wt. percent). Inhibiting strength of the inhibitor blends was determined in accordance with the procedure given in Example 2 above.

The results are presented in Table II which follows.

TABLE II

| Run No. | Inhibitor | Amount of Inhibitor (in grams in 100 ml. of Ammoniated EDTA/citric cleaning solution) | Wt. Loss (in grams) | Wt. Loss (lbs/sq ft/24 hrs) |
|---|---|---|---|---|
| 8 | gelatin | 2.5 | 0.1020 | 0.0046 |
| | benzimidazole | 2.5 | | |
| 9 | gelatin | 3.75 | 0.0755 | 0.0034 |
| | benzimidazole | 3.75 | | |
| 10 | gelatin | 5.0 | 0.0701 | 0.0032 |
| | benzimidazole | 5.0 | | |
| 11 | gelatin | 1.7 | 0.0744 | 0.0034 |
| | benzimidazole | 1.7 | | |
| | ethyl quinolinium iodide | 1.7 | | |
| 12 | gelatin | 2.5 | 0.0819 | 0.0037 |
| | benzimidazole | 2.5 | | |
| | 2-thio-4,6-dimethylpyrimidine | 0.2 | | |

EXAMPLE 4

Following the procedure described in Examples 2 and 3, other cleaning solutions may be prepared by using various carboxylic acids and inhibitors within the scope of the invention, as shown by the following illustrative table (Table III).

Table III

| No. | Inhibitor Blend: | Carboxylic Acid |
|---|---|---|
| | Add Gelatin to the following | |
| (1) | 2-aminobenzimidazole | formic |
| (2) | 2-amino-5,6-dimethylbenzimidazole | oxalic |
| (3) | 2-chloromethylbenzimidazole | acetic |
| (4) | 5,6-dimethylbenzimidazole | glycolic |
| (5) | 2-guandinobenzimidazole | pyruvic |
| (6) | 2-mercaptobenzimidazole | malonic |
| (7) | 2-methylbenzimidazole | propionic |
| (8) | 2-methyl-5-nitrobenzimidazole | lactic |
| (9) | 6-nitrobenzimidazole | B-hydroxy-propionic |
| (10) | 2-(trichloromethyl)-benzimidazole | methoxy-acetic |
| (11) | 2,5,6-trimethylbenzimidazole | glyceric |
| (12) | 2-amino-5-chlorobenzimidazole | B-iodo-propionic |
| (13) | 5-methylbenzimidazole | maleic |
| (14) | 2-benzimidazole carbamonitrile | oxaloacetic |
| (15) | 2-benzimidazole methanol | crotonic |
| (16) | 2-benzimidazolyl acetonitrile | vinylacetic |
| (17) | 2-methyl-5-octadecylbenzimidazole | succinic |
| (18) | 2-methylmercaptobenzimidazole | methyl-malonic |
| (19) | 2-benzimidazolyl urea | malic |

What is claimed is:

1. A synergistic acid inhibitor blend comprising:
(1) gelatin and
(2) benzimidazole.

2. The blend as claimed in claim 1 and
(3) a minor amount of a composition selected from the group consisting of ethyl quinolinium iodide, 2-thio-4,6-dimethyl pyrimidine hydrochloride, and a mixture of ethyl quinolinium iodide and 2-thio-4,6-dimethyl pyrimidine hydrochloride.

3. The blend of claim 2 wherein component (3) is ethyl quinolinium iodide.

4. The blend of claim 2 wherein component (3) is b 2-thio-4,6-dimethyl pyrimidine hydrochloride.

5. The blend of claim 2 wherein component (3) is a mixture of ethyl quinolinium iodide and 2-thio-4,6-dimethyl pyrimidine hydrochloride.

6. A cleaning solution comprising:
(1) from about 75 to about 99.99 weight percent of an aqueous solution of at least one carboxylic acid, the pH of said aqueous solution being between about 1.7 and about 7; and
(2) from about 0.01 to about 25 weight percent of a synergistic inhibitor blend comprising gelatin and benzimidazole, said weight percentages being based on the combined total weight of components (1) and (2) contained in the cleaning solution.

7. The cleaning solution as defined in claim 6 in which component (1) is an aqueous solution of citric acid.

8. The cleaning solution as defined in claim 6 in which component (1) is an aqueous solution of ethylenediaminetetraacetic acid.

9. The cleaning solution as defined in claim 6 in which component (1) is an aqueous solution of ethylenediaminetetraacetic acid and citric acid.

10. A cleaning solution comprising:
(1) from about 75 to about 99.99 weight percent of an aqueous solution of at least one ammoniated carboxylic acid, the pH of said aqueous solution being between about 3 and about 6.5; and
(2) from about 0.01 to about 25 weight percent of a synergistic inhibitor blend comprising gelatin and benzimidazole, said weight percentages being based on the combined total weight of components (1) and (2) contained in the cleaning solution.

11. The cleaning solution as defined in claim 10 in which component (1) is an aqueous solution of ammoniated citric acid.

12. The cleaning solution as defined in claim 10 in which component (1) is an aqueous solution of ammoniated ethylenediaminetetraacetic acid.

13. The cleaning solution as defined in claim 10 in which component (1) is an aqueous solution of ammoniated ethylenediaminetetraacetic acid and ammoniated citric acid.

14. A cleaning composition concentrate blend comprising:
(1) from about 25 to about 99.95 weight percent of at least one carboxylic acid; and
(2) from about 0.05 to about 75 weight percent of a synergistic inhibitor blend comprising gelatin and benzimidazole, said weight percentages being based on the combined total weight of components (1) and (2) contained in the blend.

15. The blend as defined in claim 14 in which component (1) is citric acid.

16. The blend as defined in claim 14 in which component (1) is ethylenediaminetetraacetic acid.

17. The blend as defined in claim 14 in which component (1) is ethylenediaminetetraacetic acid and citric acid.

18. A process for cleaning water scale or other undesirable water-insoluble deposits from the interior surfaces of metal industrial equipment comprising contacting said deposits with an aqueous carboxylic acid cleaning solution which comprises water, carboxylic acid and a synergistic inhibitor blend comprising gelatin and benzimidazole.

19. The process of claim 18 wherein the acid solution is an aqueous solution of ammoniated citric acid.

20. The process of claim 18 wherein the acid solution is an aqueous solution of ammoniated ethylenediaminetetraacetic acid.

21. The process of claim 18 wherein the acid solution is a mixture of ammoniated citric acid and ammoniated ethylenediaminetetraacetic acid.

* * * * *

UNITED STATES PATENT AND TRADEMARK OFFICE

CERTIFICATE OF CORRECTION

PATENT NO. : 4,209,418

DATED : June 24, 1980

INVENTOR(S) : James D. Anderson

It is certified that error appears in the above—identified patent and that said Letters Patent is hereby corrected as shown below:

On the cover page of the patent, in the title, insert diagonal --/-- between "GELATIN" and "BENZIMIDAZOLE".

On the cover page of the patent, in the lines identified by "[73] Assignee:", for "Union Carbide Corporation, New York, N.Y." read --Amchem Products, Inc., Ambler, Pa.--.

Column 3, line 55, for "-CClhd 3" read --$CCl_3$--.

Column 5, line 9, for "acid" read --acids--.

In the Abstract, in the first diagrammatical formula, the N bond C should be a double bond as follows:

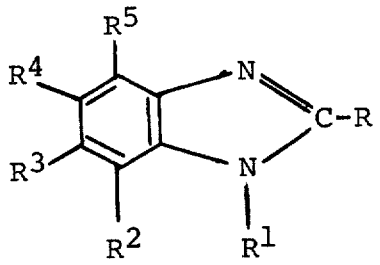

Signed and Sealed this

Fourth Day of November 1980

[SEAL]

Attest:

SIDNEY A. DIAMOND

Attesting Officer

Commissioner of Patents and Trademarks